US008523166B2

(12) United States Patent
Jung

(10) Patent No.: US 8,523,166 B2
(45) Date of Patent: Sep. 3, 2013

(54) PAPER DISCHARGE APPARATUS

(75) Inventor: Kijo Jung, Seoul (KR)

(73) Assignee: KRDC Co., Ltd., Seoul (KR)

( * ) Notice: Subject to any disclaimer, the term of this patent is extended or adjusted under 35 U.S.C. 154(b) by 83 days.

(21) Appl. No.: 13/188,025

(22) Filed: Jul. 21, 2011

(65) Prior Publication Data

US 2012/0032388 A1 Feb. 9, 2012

(30) Foreign Application Priority Data

Aug. 4, 2010 (KR) ..... 10-2010-0075230

(51) Int. Cl.
*B65H 37/04* (2006.01)

(52) U.S. Cl.
USPC ..... 270/58.11; 270/58.08; 399/410

(58) Field of Classification Search
USPC ..... 270/58.08, 58.11, 58.12, 58.17; 399/410
See application file for complete search history.

(56) References Cited

U.S. PATENT DOCUMENTS

| | | | | |
|---|---|---|---|---|
| 5,478,062 | A * | 12/1995 | Horiuchi et al. | 270/58.08 |
| 5,709,376 | A * | 1/1998 | Ushirogata | 270/58.11 |
| 5,782,337 | A * | 7/1998 | Langland | 198/803.1 |
| 7,487,959 | B2 * | 2/2009 | Noh | 270/58.12 |
| 7,661,666 | B2 * | 2/2010 | Terao et al. | 270/58.12 |
| 7,731,169 | B2 * | 6/2010 | Saito | 270/58.12 |
| 7,832,718 | B2 * | 11/2010 | Fukasawa et al. | 270/58.07 |
| 7,992,856 | B2 * | 8/2011 | Saito | 270/58.11 |
| 8,162,306 | B2 * | 4/2012 | Suzuki et al. | 270/58.12 |
| 2007/0278732 | A1 * | 12/2007 | Kitahara | 270/58.08 |
| 2012/0032388 | A1 * | 2/2012 | Jung | 270/58.08 |

FOREIGN PATENT DOCUMENTS

| | | | |
|---|---|---|---|
| KR | 10-2003-0008700 | A | 1/2003 |
| KR | 10-2005-0083208 | A | 8/2005 |

* cited by examiner

*Primary Examiner* — Patrick Mackey
(74) *Attorney, Agent, or Firm* — Birch, Stewart, Kolasch & Birch, LLP

(57) ABSTRACT

Disclosed is a paper discharge apparatus of optimizing the moving path of a stapler provided at the rear of the paper discharge apparatus by effectively constructing the structure of the paper discharge apparatus that discharges paper onto a stacker tray. The paper discharge apparatus includes a pair of guide side plates including first rail grooves and curved cams adjacent to the first rail grooves, a pair of paper gripping units to grip the paper on the paper stacking plate in the contact with the curved cams, a first driving unit to drive the paper gripping units, an aligning stopper provided between the guide side plates to straightly move by a predetermined distance in the paper transfer direction from front end portions of the guide side plates, and a second driving unit to previously move the aligning stopper in the paper transfer direction just before the paper gripping units.

9 Claims, 13 Drawing Sheets

PAPER DISCHARGE APPARATUS

BACKGROUND

1. Field of the Invention

The present invention relates to a paper discharge apparatus connected to a digital outputting device (e.g., copy machine or a printer) to arrange and stack paper. In particular, the present invention relates to a paper discharge apparatus capable of optimizing the moving path of a stapler provided at the rear of the paper discharge apparatus by effectively constructing the structure of the paper discharge apparatus that discharges paper onto a stacker tray.

2. Description of the Prior Art

A paper discharge apparatus 20 capable of safely transferring paper onto a stacker tray by using a griper is disclosed in Korean Patent Registration No. 405324.

As shown in FIGS. 1 and 3, after receiving and arranging paper transferred from a digital outputting device (not shown), the paper discharge apparatus 20 according to the related art discharges the paper onto the stacker tray while gripping the paper.

The paper discharge apparatus 20 includes a paper stacking plate 5, guide side plates 3, which are provided on a central portion of the paper stacking plate 5 in opposition to each other while being spaced apart from each other by a predetermined distance and formed in inner surfaces thereof with rail grooves 3*a* and at predetermined regions of both lateral sides thereof with curved cams 3*b* having the radius of curvature, and a paper gripping unit 21 gripping paper received on the paper stacking plate 5 when making contact with the curved cams 3*b* while moving along the rail grooves 3*a* of the paper stacking plate 5.

The paper gripping unit 21 includes a fixing shaft 12 having end portions and movable along the rail grooves 3*a* in the state that the end portions are fitted into the rail grooves 3*a* perpendicularly to the rail grooves 3*a*, a grip support plate 2 coupled with the fixing shaft 12, and a gripper 1 including first and second extension portions in which a boundary region between first and second extension portions 1*a* and 1*b* is coupled with the grip support plate 2 through a pin 16 so that the first and second extension portions 1*a* and 1*b* are rotated at a predetermined angle about the grip support plate 2, and the first extension portion 1*a* making contact with the grip support plate 2 through an elastic member.

In addition, the paper gripping unit 21 includes a driving unit 22 allowing the paper gripping unit 21 to circulate along the rail grooves 3*a*.

In the paper discharge apparatus 20 having the above structure, since an aligning stopper 44 for discharged papers is integrated with an end portion of the guide side plate 3, the grip support plate 2 and the gripper 1 must be aligned behind the aligning stopper 44 in order to allow the paper gripping unit 21 to grip paper.

If the grip support plate 2 and the gripper 1 of the paper gripping unit 21 are aligned behind the aligning stopper 44, when a stapler 33 acting as a paper finishing apparatus is installed in a limited region, the moving path of the stapler 33 must be curved to prevent the stapler 33 from interfering with the paper gripping unit 21 when the stapler 33 moves, as shown in FIG. 1.

If the moving path of the stapler 33 is curved, the moving time of the stapler 33 may be delayed.

In addition, since another device cannot be installed in the movement space of the stapler 33, there is limitation to reduce the size of an apparatus.

SUMMARY

Accordingly, the present invention has been made to solve the above-mentioned problems occurring in the prior art, and an object of the present invention is to provide a paper discharge apparatus capable of controlling a moving path of a stapler and reducing the moving time of the stapler by allowing the stapler, which moves perpendicularly to a paper discharge direction, to move on a linear moving path.

Another object of the present invention is to install a paper discharge apparatus and a stapler in a limited space in such a manner that the paper discharge apparatus and the stapler can be optimally operated.

Still another object of the present invention is to provide a paper discharge apparatus capable of stacking several pieces of discharged paper on the stacker tray while accurately aligning the discharged paper in line with each other without scattering the paper.

To accomplish the above objects of the present invention, there is provided a paper discharge apparatus including a pair of guide side plates including first rail grooves configured to circulate in a transfer direction of paper transferred to a paper stacking plate and curved cams adjacent to the first rail grooves, a pair of paper gripping units to grip the paper received on the paper stacking plate when making contact with the curved cams while moving along the first rail grooves of the guide side plates, a first driving unit to drive the paper gripping units to allow the paper gripping units to circulate along the first rail grooves, an aligning stopper for discharged paper, which is provided between the guide side plates to straightly move by a predetermined distance in the paper transfer direction from front end portions of the guide side plates, and a second driving unit to previously move the aligning stopper in the paper transfer direction just before the paper gripping units reach the front end portions of the guide side plates.

In addition each paper gripping unit includes a fixing shaft having an end portion and movable along the first rail groove in a state that the end portion is fitted into the first rail groove perpendicularly to the first rail groove, a grip support plate coupled with the fixing shaft, and a gripper including first and second extension portions, in which a boundary region between the first and second extension portions is coupled with the grip support plate through a pin so that the first and second extension portions are rotated at a predetermined angle about the grip support plate, and the first extension portion makes contact with the grip support plate by interposing an elastic member between the first and second extension portions.

In addition, the boundary region between the first and second extension portions is fixed onto the fixing shaft together with the grip support plate, and the elastic member is fitted around the fixing shaft to elastically support the gripper.

In addition, the paper discharge apparatus further comprises a boss provided at an outer portion of the second extension portion of the gripper to make contact with the curved cam of the guide side plate. The first extension portion of the gripper is spaced apart from the grip support plate to grip an end portion of paper aligned on the aligning stopper when the boss makes contact with the curved cam.

In addition, the aligning stopper includes second rail grooves provided in inner surfaces of the guide side plates in parallel to the first rail grooves, respectively, a slide block having both ends fitted into the second rail grooves to move back and forth along the second rail grooves, and an ejector plate coupled with a top surface of the slide block to stop and transfer an end portion of the paper which is transferred to the paper stacking plate, in which the slide block moves back and forth along the second rail grooves by the second driving unit.

As described above, the paper discharge apparatus according to the present invention includes a pair of guide side plates including first rail grooves configured to circulate in a transfer direction of paper transferred to a paper stacking plate and curved cams adjacent to the first rail grooves, a pair of paper gripping units to grip the paper received on the paper stacking plate when making contact with the curved cams while moving along the first rail grooves of the guide side plates, a first driving unit to drive the paper gripping units to allow the paper gripping units to circulate along the first rail grooves, and an aligning stopper for discharged paper, which is provided between the guide side plates to straightly move by a predetermined distance in the paper transfer direction from front end portions of the guide side plates, thereby moving the stapler, which is installed at the rear portion of the paper discharge apparatus, on a linear moving path, so that the moving time of the stapler can be reduced.

In addition, the paper discharge apparatus and the stapler are effectively installed in a limited space, so that an apparatus size can be reduced, and several pieces of discharged paper can be stacked on the stacker tray while being exactly aligned in line with each other without being scattered.

DETAILED DESCRIPTION OF THE EMBODIMENTS

Hereinafter, the technical configuration and operations of the present invention will be described in detail with reference to FIGS. 4 to 14.

Figure 1:
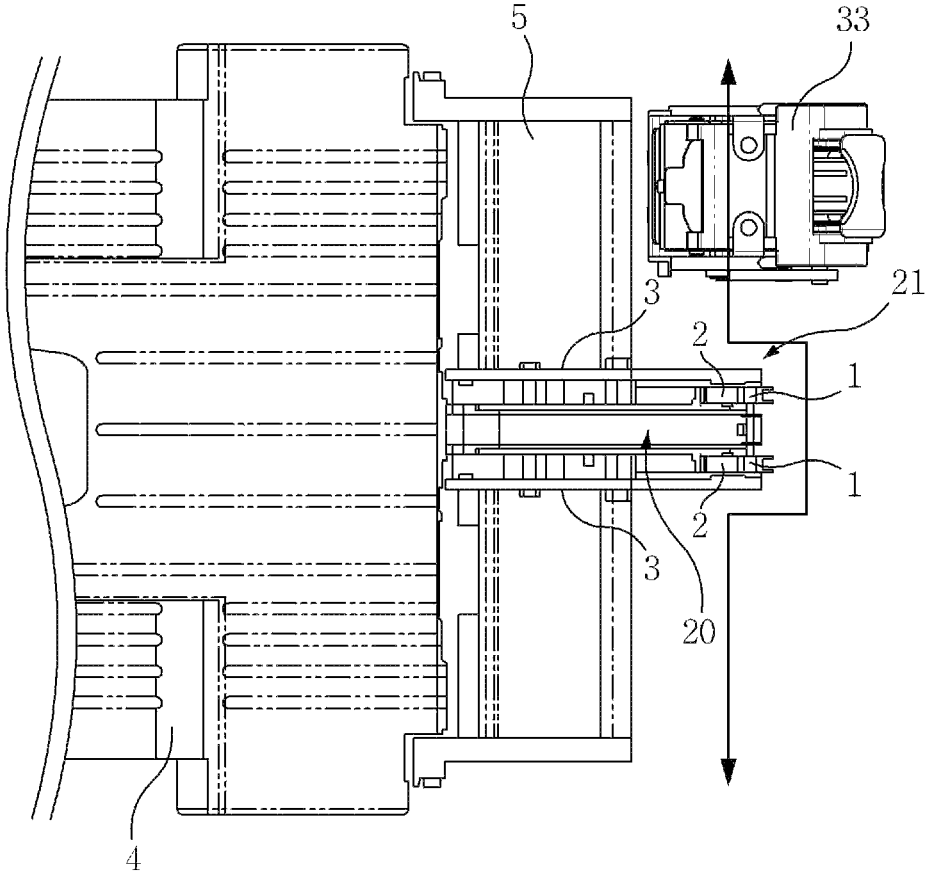
FIG. 1 is a plan view showing a paper discharge apparatus installed on a stacker tray according to the related art.
Figure 2:
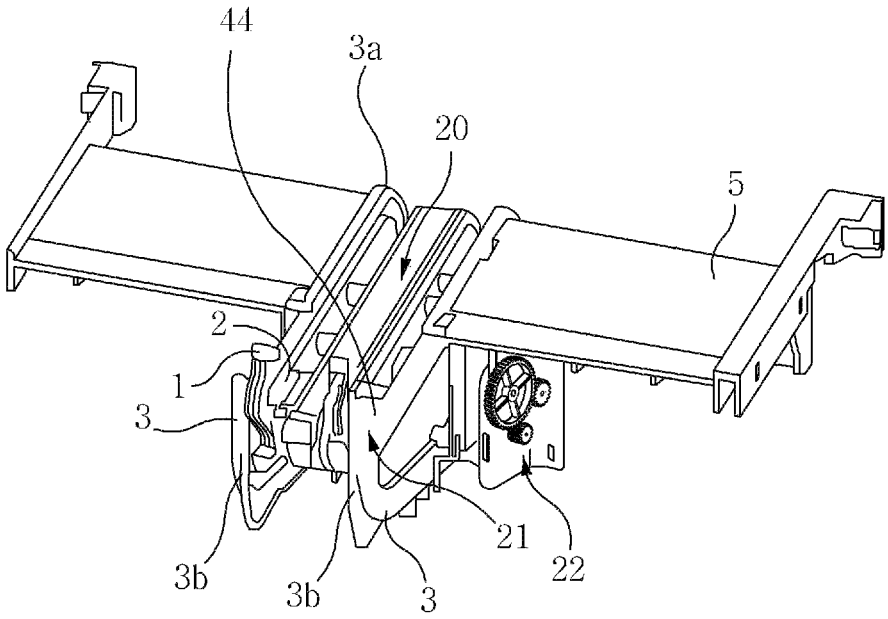
FIG. 2 is a perspective view showing the paper discharge apparatus according to the related art.
Figure 3:
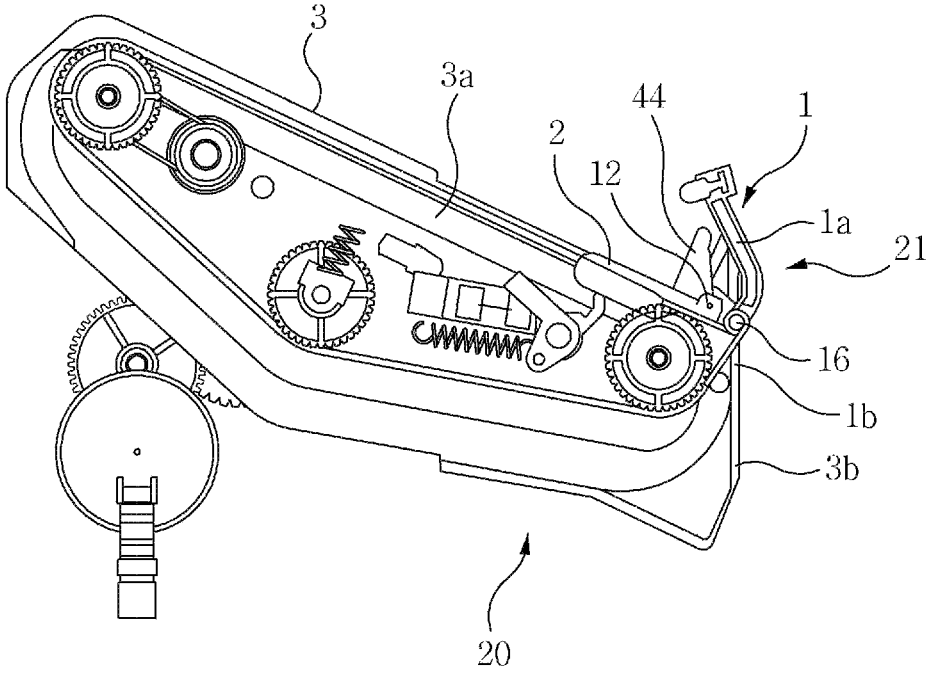
FIG. 3 is a sectional view showing the paper discharge apparatus according to the related art.
Figure 4:
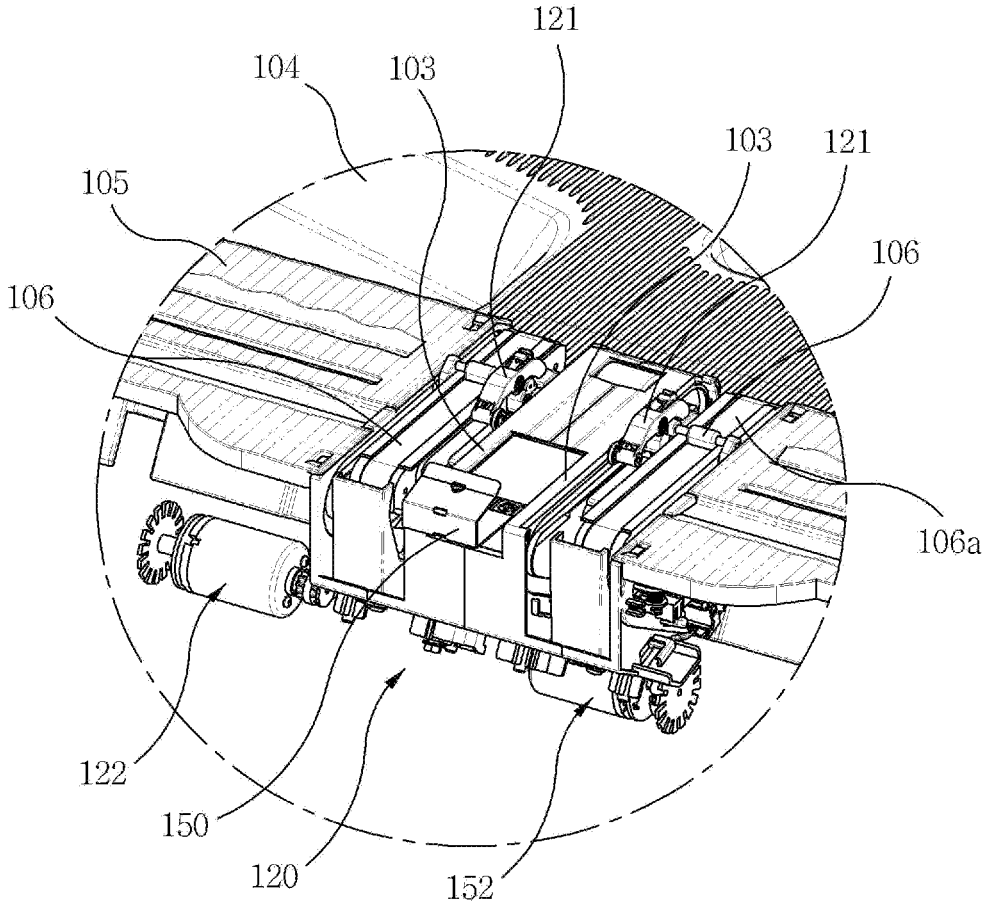
FIG. 4 is a perspective view showing a paper discharge apparatus installed on a stacker tray according to the present invention.
Figure 5:
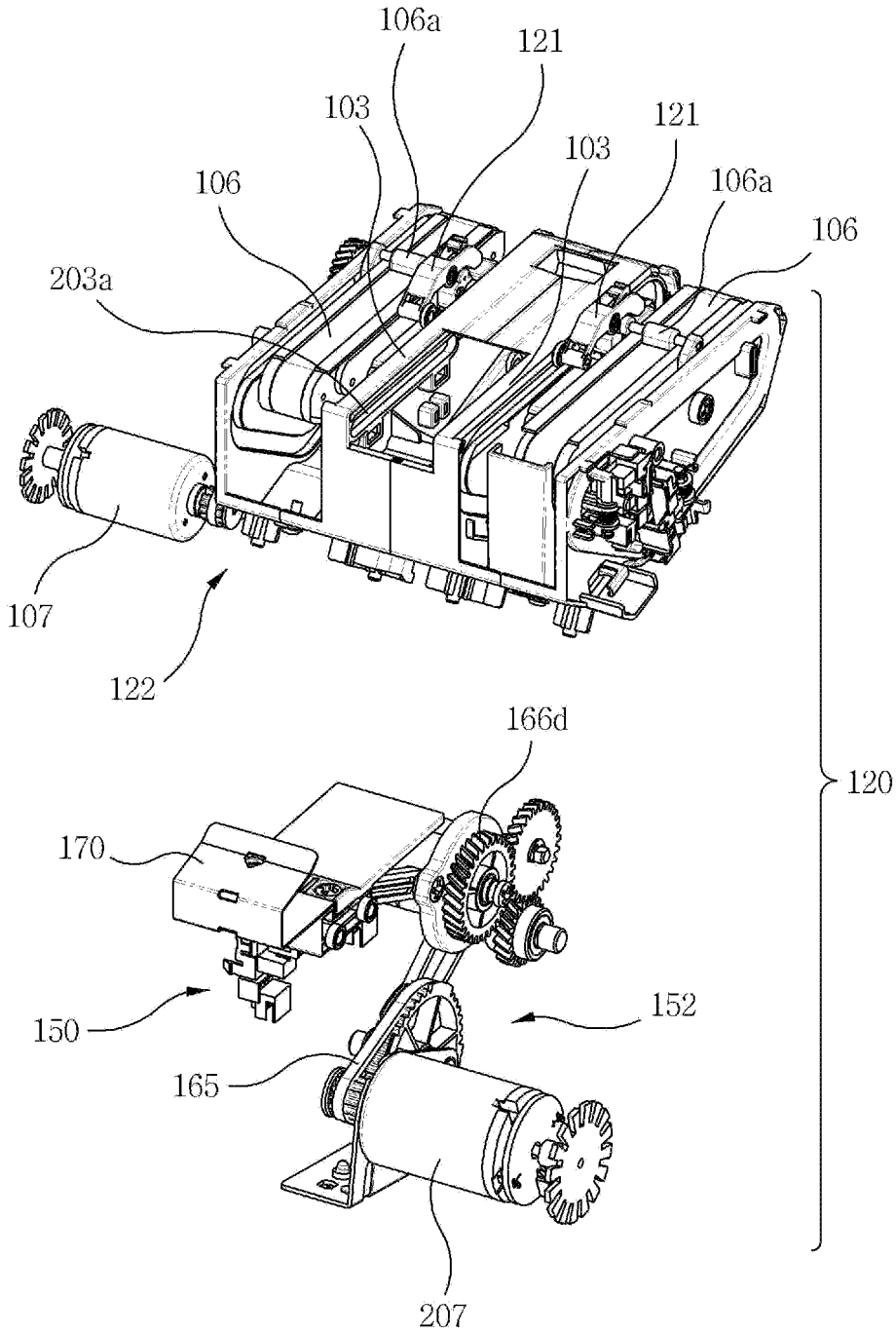
FIG. 5 is an exploded perspective view showing main components of FIG. 4.
Figure 6:
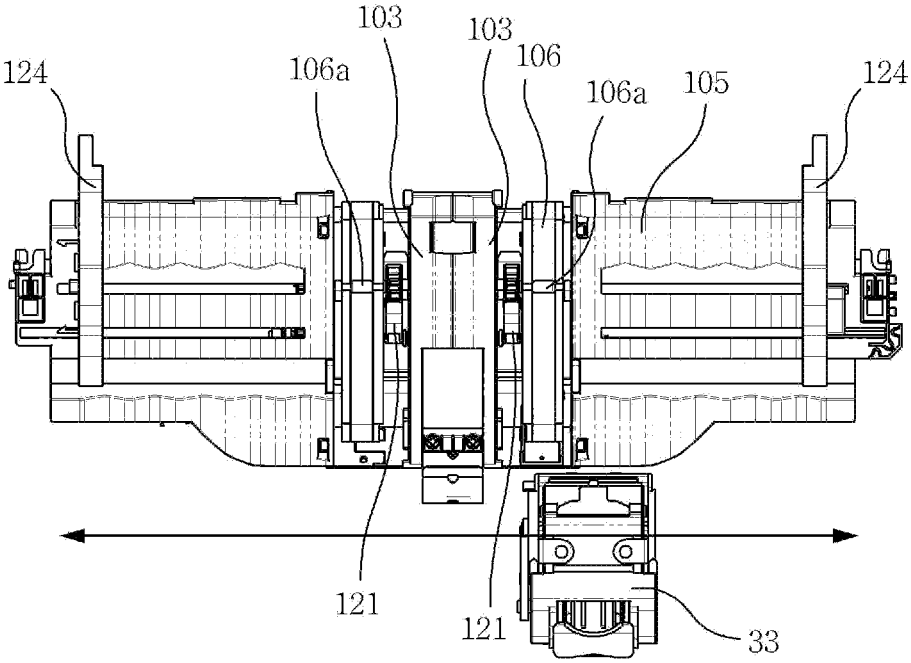
FIG. 6 is a plan view showing the moving path of a stapler in the paper discharge apparatus according to the present invention.
Figure 7:
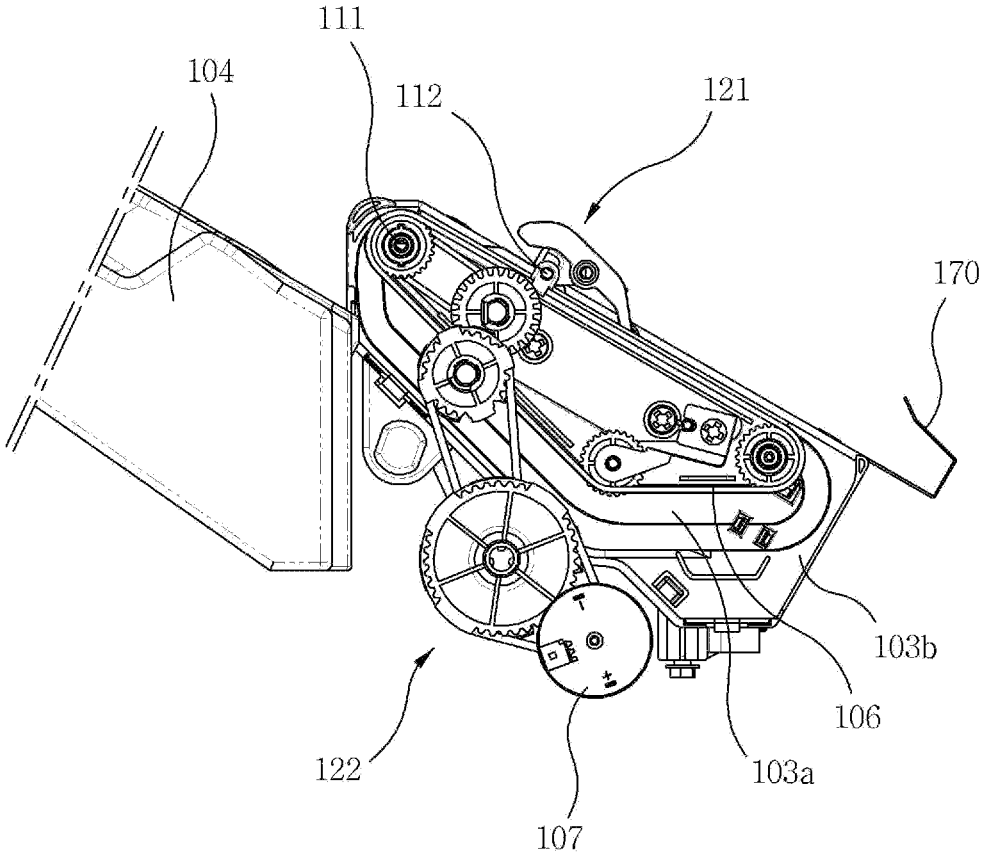
FIG. 7 is a side view showing a paper gripping unit according to the present invention.
Figure 8:
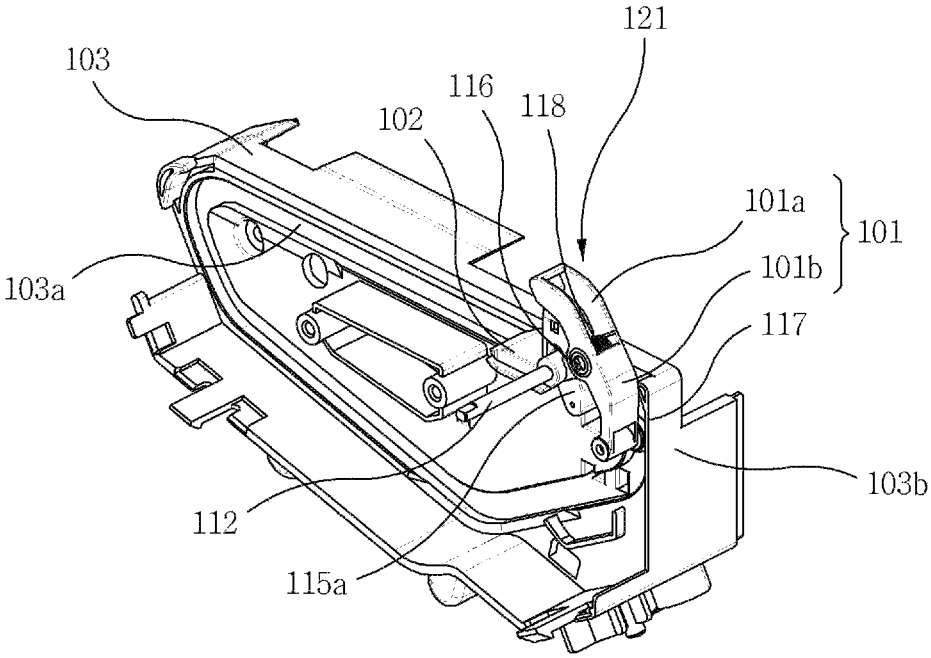
FIG. 8 is a perspective view showing main components of the paper gripping unit according to the present invention.
Figure 9:
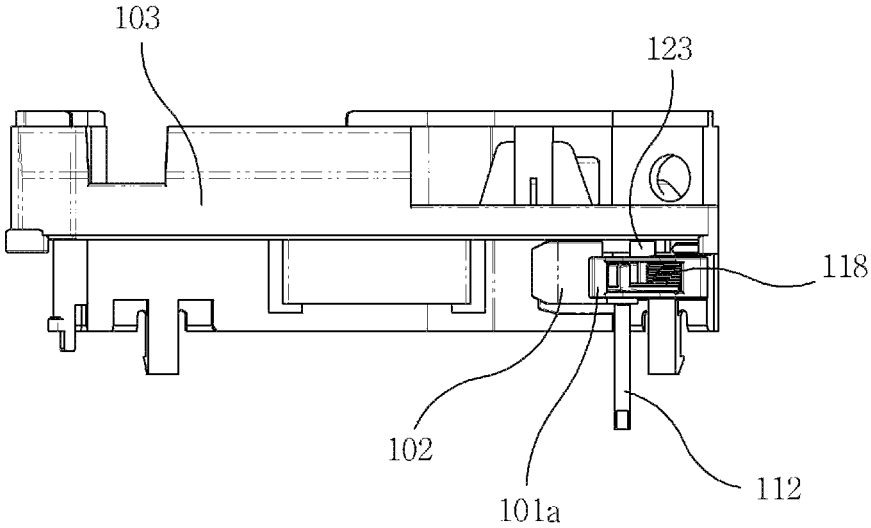
FIG. 9 is a plan view of FIG. 8.
Figure 10:
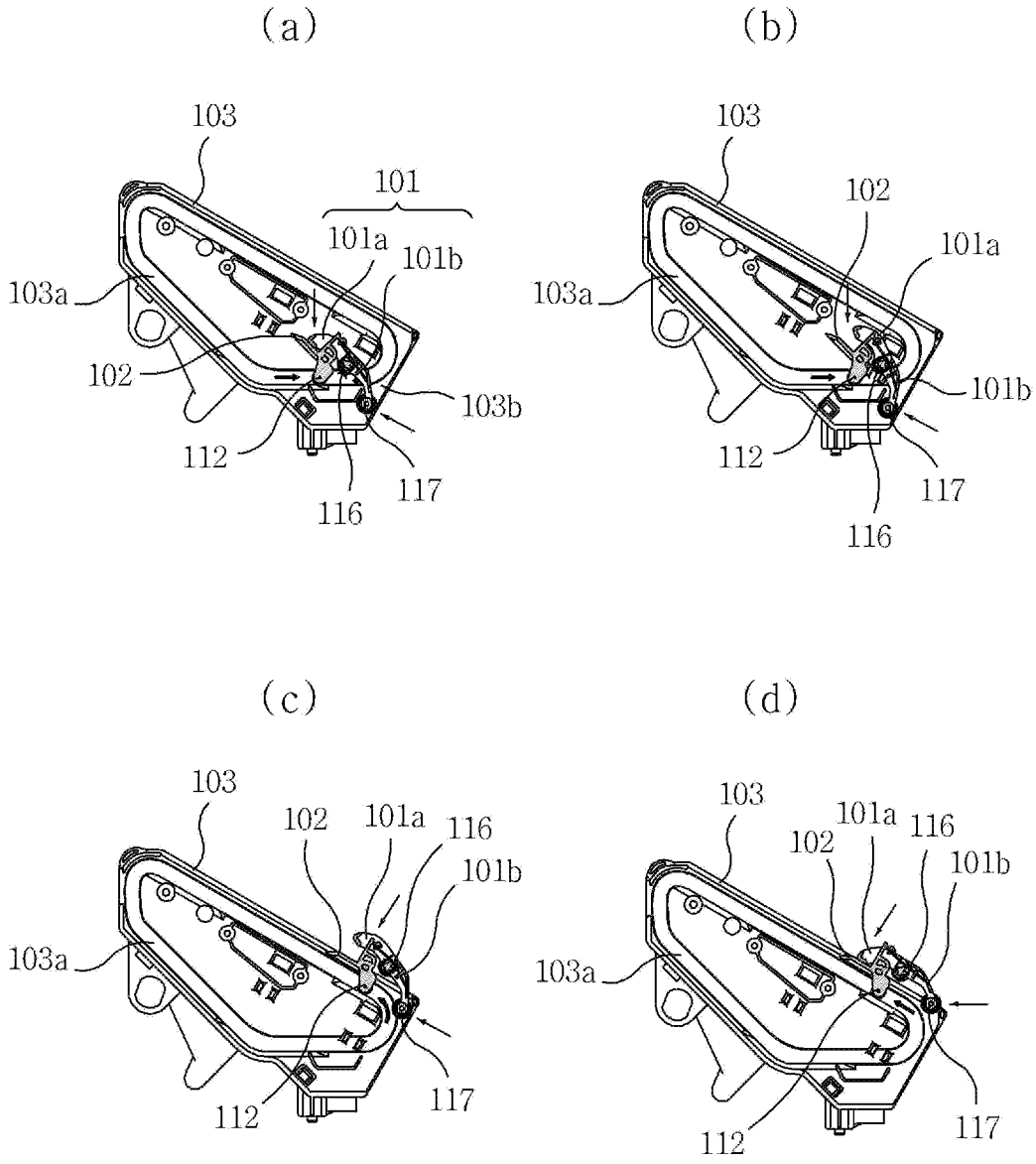
FIGS. 10A to 10D are views showing the operation of the paper gripping unit according to the present invention.

A paper stacking plate 105 temporarily receives paper discharged from a digital outputting device (not shown) as shown in FIGS. 4 to 6. The paper stacking plate 105 includes a jogger 124 provided on a top surface of a receiving portion thereof to move left or right so that the received paper can be aligned.

The paper stacking plate 105 is provided at the central portion thereof with a paper discharge apparatus 120 to grip plural pieces of paper received on the paper stacking plate 105 and transfer the paper onto a stacker tray 10.

The paper discharge apparatus 120 is configured to grip plural pieces of paper temporarily received on the paper stacking plate 105 and stably transfer the paper onto the stacker tray 104 without scattering the paper. The paper discharge apparatus 120 includes a pair of guide side plates 103, a pair of paper gripping units 121 to grip paper received on the paper stacking plate 105 while moving along the guide side plate 103, a first driving unit 122 to drive the paper gripping units 121, an aligning stopper 150 provided between the guide side pates 103 to straightly move by a predetermined distance in a paper transfer direction from front end portions of the guide side plates 103, and a second driving unit 152 to previously move the aligning stopper 150 in the paper transfer direction just before the paper gripping units 121 reach the front end portions of the guide side plates 103.

As shown in FIGS. 6 to 9, the guide side plates 103, which have a circulation orbit to allow the paper gripping unit 121 to circulate, are provided at the central portion of the paper stacking plate 105 in the paper transfer direction while being parallel to each other. Each guide side plate 103 includes a first rail groove 103*a* and a curved cam 103*b* forming the circulation orbit.

The circulation orbit of the first rail groove 103*a* is perpendicular to the surface of the paper stacking plate 105. In addition, the curved cam 103*b* is provided at one side of the front end of the guide side plate 103, which makes the circulation orbit of the first rail groove 103*a* formed in the shape of an oval, in adjacent to the first rail groove 103*a*.

The paper gripping unit 121 fitted into the guide side plate 103 to be driven includes a fixing shaft 112 having one end fitted into the first rail groove 103*a* perpendicularly to the first rail groove 103*a* so that the fixing shaft 112 is movable along the first rail groove 103*a*, a grip support plate 102 coupled with the fixing shaft 112, and a gripper 101 in which a boundary region between first and second extension portions 101*a* and 101*b* is coupled with the grip support plate 102 in such a manner that the first and second extension portions 101*a* and 101*b* can rotate at a predetermined angle about the grip support plate 102. A bearing or a roller 123 may be additionally installed around the end portion of the fixing shaft 112 fitted into the first rail groove 103*a* so that the fixing shaft 112 can be smoothly moved.

In particular, a support member 115*a* is integrated with the grip support plate 102 at a rear portion of the grip support plate 102 coupled with the fixing shaft 112 while slightly protruding from the grip support plate 102. The support member 115*a* is coupled with the boundary region between the first and second extension portions 101*a* and 101*b* of the gripper 101 by interposing a pin 116 between the boundary region and the support member 115*a*. A spring 118 is coupled with the pin 116 to elastically support the gripper 101.

A boss 117 is provided at an outer portion of the second extension portion 101*b* of the gripper 101 to make contact with the curved cam 103*b* of the guide side plate 103. When the boss 117 makes contact with the curved cam 103*b*, the first extension portion 101*a* of the gripper 101 is spaced apart from the grip support plate 102 by the action of the spring 118, so that the first extension portion 101*a* of the gripper 101 maintains a distance from the grip support plate 102. When the boss 117 does not make contact with the curved cam 103*b*, the first extension portion 101*a* of the gripper 101 makes contact with the grip support plate 102 by the action of the spring 110, so that paper can be gripped between the first extension portion 101*a* of the gripper 101 and the grip support plate 102.

The first driving unit 122 to drive the paper gripping unit 121 may include transfer belts 106 that rotate according to the rotation of a driving rotational shaft 111 and a driving motor 107 to rotate the driving rotational shaft 111. The driving rotational shaft 111 may be indirectly driven by interposing a belt and a plurality of gears between the driving motor 107 and the driving rotational shaft 111.

The paper gripping unit 121 is fixed by fitting the fixing shaft 112 into a fixing member 106*a* of the transfer belt 106.

As the transfer belt 106 rotates, the paper gripping unit 121 circulates along the first rail groove 103*a* in cooperation with the transfer belt 106.

The transfer belts 106 are installed at outer portions of the paper gripping units 121 to fix the paper gripping units 121 thereon, and the guide side plates 103 are installed at the central portion of the paper discharge apparatus 120 in symmetrical to each other while facing each other.

The operation of the paper gripping unit 121 having the above structure will be described with reference to FIGS. 10A to 10D.

As shown in FIG. 10A, when the boss 117 is positioned at a starting point of the curved cam 117 of the guide side plate 103, the grip support plate 102 is in the contact with the first extension portion 101*a* of the gripper 101 by the elastic support force of the spring.

As shown in FIG. 10B, if the paper gripping unit 121 farther moves along the first rail groove 103*a*, the boss 117 is locked with the curved cam 103*b* so that the boss 117 is temporarily stopped. In this state, since the fixing shaft 112 moves toward the curved cam 103*b*, the gripper 101 rotates about the pin 116, so that the grip support plate 102 starts to be spaced apart from the first extension portion 101*a* of the gripper 101.

As shown in FIG. 10C, the grip support plate 102 maintains the distance from the first extension portion 101*a* until the fixing shaft 112 is lifted onto the surface of the paper stacking plate 105 after passing through a curved section of the first rail groove 103*a*.

If the fixing shaft 112 farther moves along the first rail groove 103*a* from the state of FIG. 10C so that the boss 117 is positioned out of the curved cam 103*b* as shown in FIG. 10D, the grip support plate 102 and the first extension portion 101*a* of the gripper 01 return to an original position by the restoring force of the spring so that the grip support plate 102 makes contact with the first extension portion 101*a*.

The gripper 1 grips paper stacked on the paper stacking plate 105 when returning to the original position.

If the grip support plate 102 and the first extension portion 101*a* of the gripper 101 continuously move while gripping paper to reach the stacker tray 104, the paper is transferred to the stacker tray 104, and a lower end portion of the paper is positioned at the boundary region between the stacker tray 104 and the paper discharge apparatus 120.

Since the fixing shaft 112 continuously moves down along the first rail groove 103*a* in the state that the paper has been transferred onto the stacker tray 104 as described above, the first extension portion 101*a* of the gripper 101, which has gripped an end portion of the paper, is instantly lifted up by overcoming elastic force of the spring, so that the first ending portion 101*a* releases the grip of the paper.

After the grip of the paper transferred on the stacker tray has been released, the first extension portion 101*a* of the gripper 101 and the grip support plate 102 make contact with each other again and move toward the curved cam 103*b* along the first rail groove 103*a*.

Figure 11:
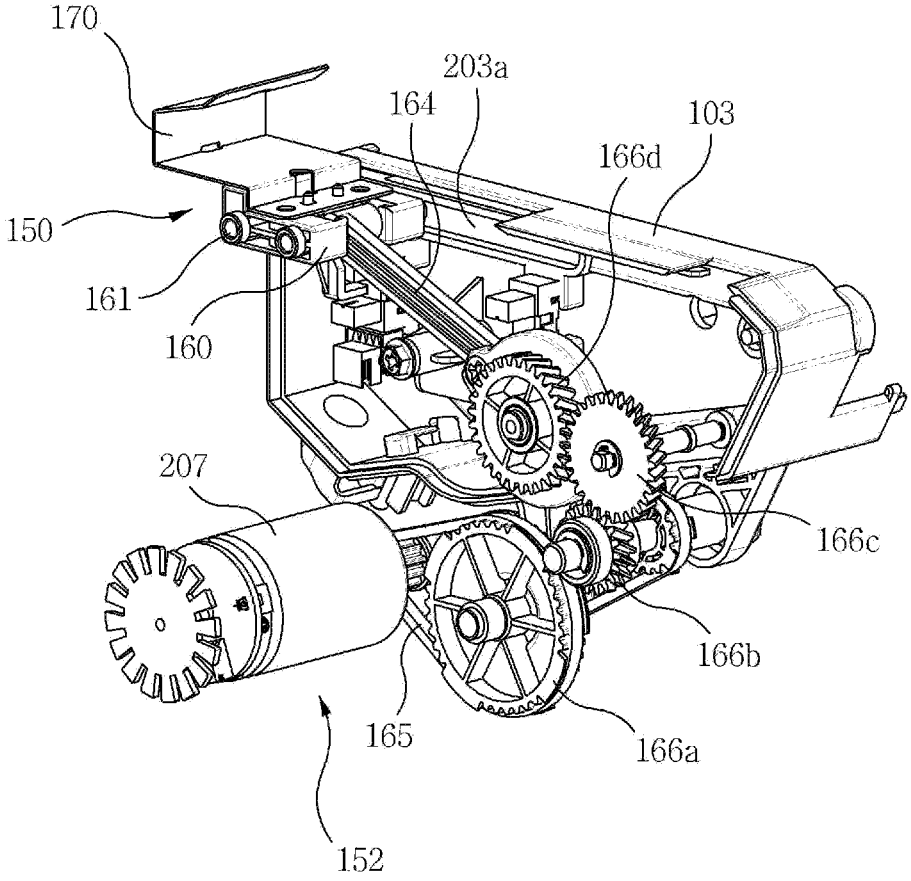
FIG. 11 is a perspective view showing main components of an aligning stopper according to the present invention at one side.
Figure 12:
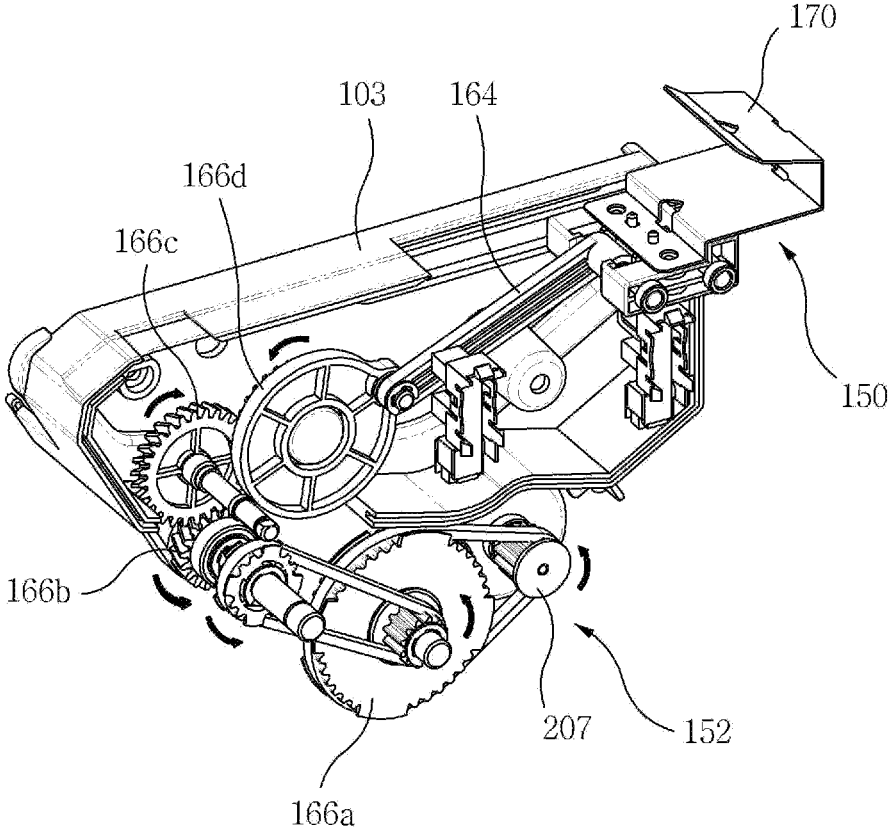
FIG. 12 is a perspective view showing main components of the aligning stopper according to the present invention at an opposite side.
Figure 13:
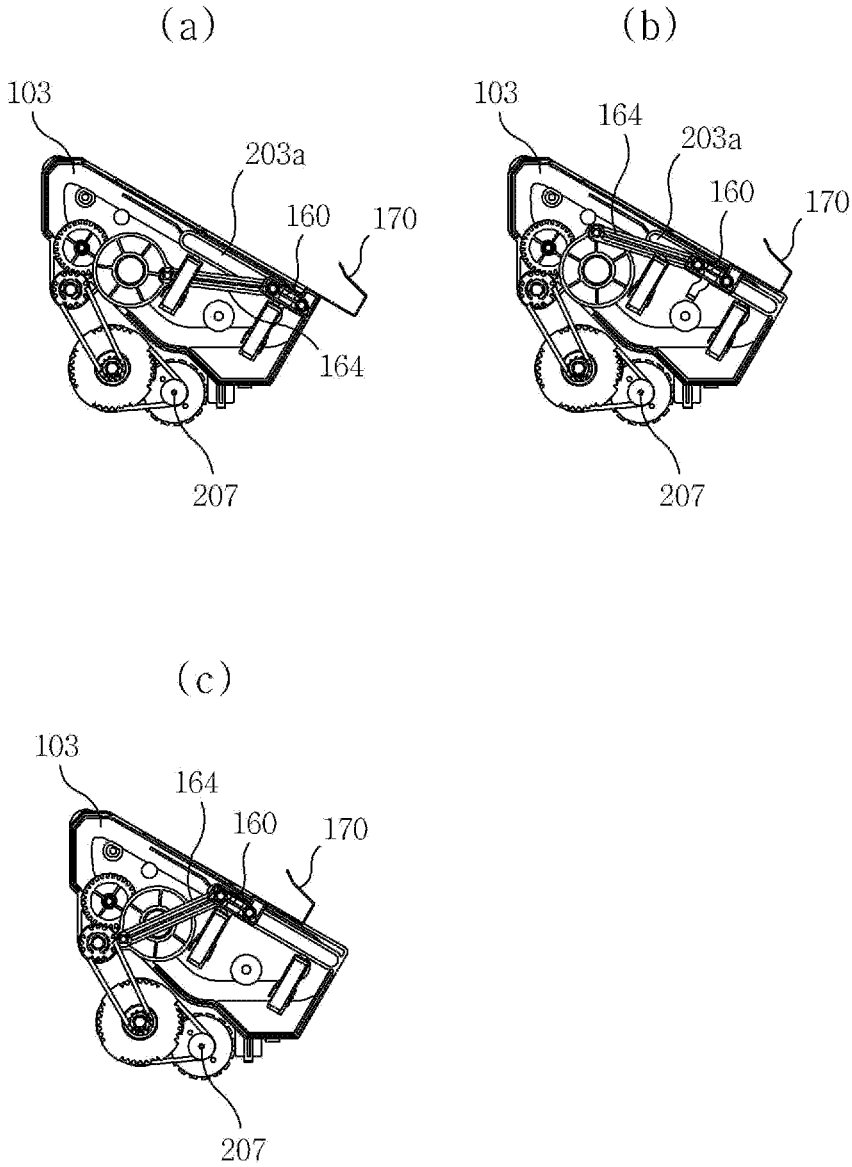
FIG. 13 is a view showing the operation of the aligning stopper according to the present invention.
Figure 14:
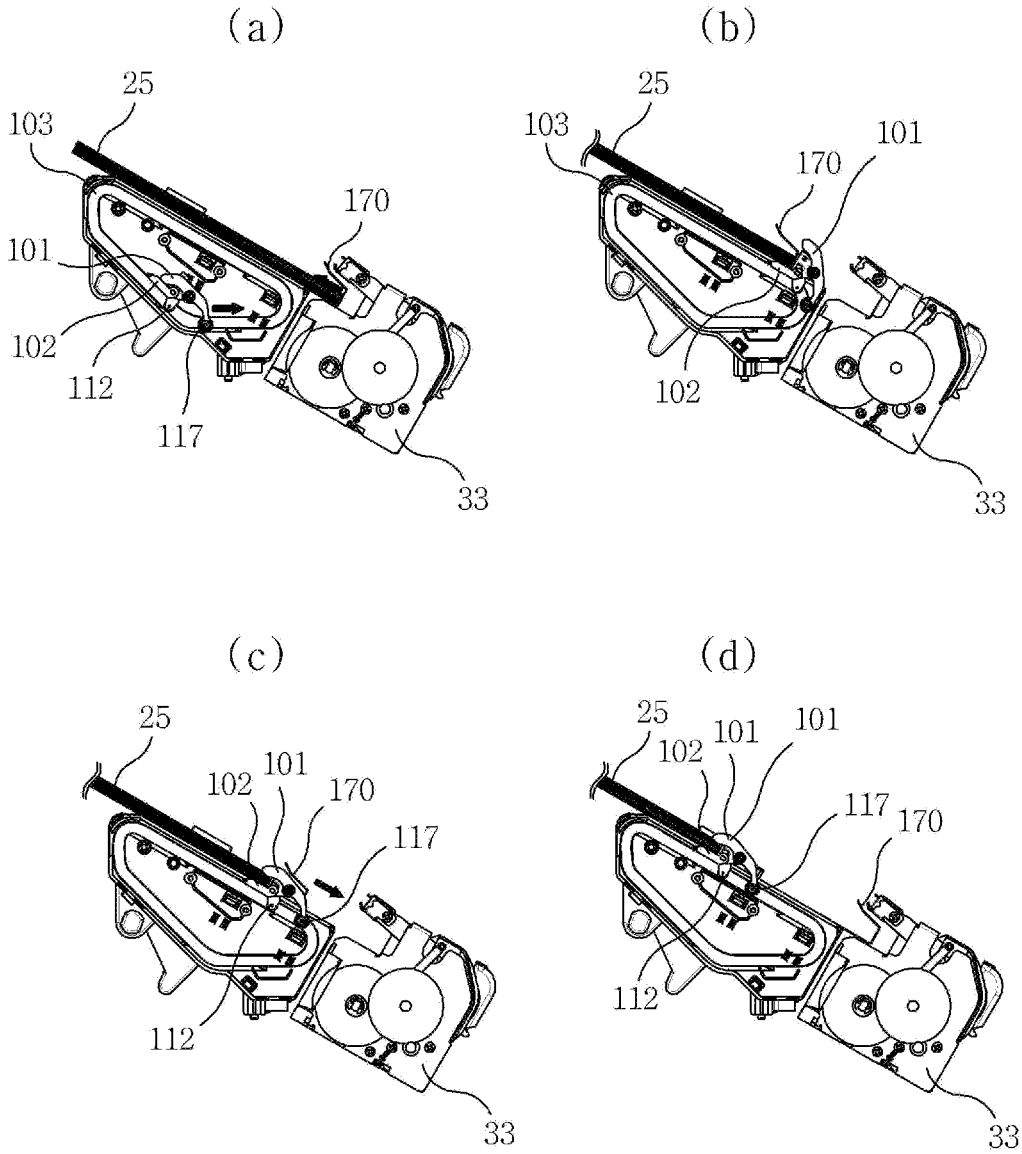
FIG. 14 is a view showing the operation of the paper discharge apparatus according to the present invention.

Meanwhile, as shown in FIGS. 11 and 12, the aligning stopper 150, which is movable up and down by a predetermined distance in the paper transfer direction, and the second driving unit 152 to drive the aligning stopper 150 are installed between the guide side plates 103.

The aligning stopper 150 includes second rail grooves 203*a* provided in the inner surfaces of the guide side plates 103 in parallel to the first rail grooves 103*a*, respectively, slide blocks 160 having both ends fitted into the second rail grooves 203*a* to move backward and forth along the second rail grooves 203*a*, and ejector plates 170 coupled with a top surface of the slide blocks 160 and having a substantially C shape to stop and transfer an end portion of paper which is transferred to the paper stacking plate 105.

The slide block 160 is provided at both end portions thereof with roll bearings 161 to smoothly move along the second rail grooves 203*a*.

The slide block 160 interposes a timing belt 165, a plurality of gears 166*a*, 166*b*, 166*c*, and 166*d*, and a crank arm 164 between the slide block 160 and a driving motor 207, and is driven by the driving motor 207.

The slide block 160 can reciprocate along the second rail groove 203*a* by the action of a crank arm 164 regardless of the rotation direction of the driving motor 207.

The technique of allowing the sliding block 160 to reciprocate along the second rail groove 203*a* is not limited to the technique of the second driving unit 152. In other words, the sliding block 160 can reciprocate along the second rail groove 203*a* through various techniques generally known in the art.

The operating procedure of the aligning stopper 150 will be described with reference to FIGS. 13A to 13C.

If the slide block 160 is moved toward the front end portion of the guide side plate 103 by driving the driving motor 207 as shown in FIG. 13A, the ejector plate 170 protrudes out of the front end portion of the guide side plate 103 by a predetermined distance.

In this state, if the driving motor 207 is more rotated, the ejector plate 170 moves in the paper transfer direction as the slide block 160 moves in the paper transfer direction as shown in FIGS. 13B and 13C.

After the slide block 160 has been moved along the second rail groove 302*a* by a stroke distance of the crank arm 164, the slide block 160 returns to the position of FIG. 13A and stands by.

Even if the stapler 33 straightly moves left or right as shown in FIG. 6 in the state that the ejector plate 170 protrudes out of the front end portion of the guide side plate 103 and stands by, since the ejector plate 170 is positioned in the space (not shown) of the opening of the stapler 33, the ejector plate 170 does not exert an influence on the movement of the stapler 33.

Hereinafter, the operating procedure according to the present invention including the aligning stopper 150 and the paper gripping unit 121 will be described with reference to FIGS. 14A to 14D.

As shown in FIG. 14A, after the ejector plate 170 has been moved backward to the front end portion (home position) of the guide side plate 103, an end of the paper 25, which is transferred from a digital outputting device such as a copy machine or a printer, is stopped at the substantially C shaped groove of the ejector plate 170. In this state, the paper 25 is stacked on the paper stacking plate 105.

If several pieces of paper have been stacked on the paper stacking plate 105, before the gripper 101 and the grip support plate 102 are lifted up to the surface of the paper stacking plate 105 as shown in FIG. 14B, the ejector plate 170 is moved, so that the end portion of the paper 25 is moved toward the stacker tray 104 by a predetermine distance.

In other words, the end portion of the paper 25 is previously moved by a predetermined distance by moving the ejector plate 170, which constitutes the aligning stopper 150, prior to the gripper 101 and the grip support plate 102, which constitute the paper gripping unit 120, from the home position.

Subsequently, as shown in FIG. 14C, when the preceding ejector plate 170 does not move any more by the action of the crank arm 164, but returns to the original position thereof, the following gripper 101 and grip support plate 102 are lifted onto the top surface of the end portion of the paper stacking plate 105 to grip the end portion of the paper 25.

Next, as shown in FIG. 14D, the ejector plate 170 returns to the original position and stands by for a duration in which the paper 25 is gripped between the gripper 101 and the grip support plate 102 and transferred to the stacker tray 104.

As described above, the present invention can provide a paper discharge apparatus capable of ensuring a paper discharge path differently from the related art while allowing the stapler 33 to perform straight motion by configuring the paper gripping unit 121 not to protrude from the guide side plate 103 and by configuring the ejector plate 170 serving as the stopper for a paper to reciprocate by a predetermined distance toward the inner portion of the guide side plate from the outer portion of the guide side plate.

Therefore, it will be understood to those skilled in the art will appreciate that various modifications, additions and substitutions are possible, without departing from the scope and spirit of the invention as disclosed in the accompanying claims.

What is claimed is:

1. A paper discharge apparatus comprising:

a pair of guide side plates including first rail grooves configured to circulate in a transfer direction of paper transferred to a paper stacking plate and curved cams adjacent to the first rail grooves;

a pair of paper gripping units to grip the paper received on the paper stacking plate when making contact with the curved cams while moving along the first rail grooves of the guide side plates;

a first driving unit to drive the paper gripping units to allow the paper gripping units to circulate along the first rail grooves;

an aligning stopper for discharged paper, which is provided between the guide side plates to straightly move by a predetermined distance in the paper transfer direction from front end portions of the guide side plates; a second driving unit to previously move the aligning stopper in the paper transfer direction just before the paper gripping units reach the front end portions of the guide side plates; and a stapler having an opening, wherein the stapler is installed outside the front end portions of the guide side plates such that the stapler is movable linearly, wherein the aligning stopper includes second rail grooves provided in inner surfaces of the guide side plates in parallel to the first rail grooves, respectively, a slide block having both ends fitted into the second rail grooves to move back and forth along the second rail grooves, and an ejector plate coupled with a top surface of the slide block to stop and transfer an end portion of the paper which is transferred to the paper stacking plate, in which the slide block moves back and forth along the second rail grooves by the second driving unit.

2. The paper discharge apparatus of claim 1, wherein each paper gripping unit includes a fixing shaft having an end portion and movable along the first rail groove in a state that the end portion is fitted into the first rail groove perpendicularly to the first rail groove, a grip support plate coupled with the fixing shaft, and a gripper including first and second extension portions, in which a boundary region between the first and second extension portions is coupled with the grip support plate through a pin so that the first and second extension portions are rotated at a predetermined angle about the grip support plate, and the first extension portion makes contact with the grip support plate by interposing an elastic member between the first and second extension portions.

3. The paper discharge apparatus of claim 2, wherein the boundary region between the first and second extension portions is fixed onto the fixing shaft together with the grip support plate, and the elastic member is fitted around the fixing shaft to elastically support the gripper.

4. The paper discharge apparatus of claim 2, further comprising a boss provided at an outer portion of the second extension portion of the gripper to make contact with the curved cam of the guide side plate, wherein the first extension portion of the gripper is spaced apart from the grip support plate to grip an end portion of paper aligned on the aligning stopper when the boss makes contact with the curved cam.

5. The paper discharge apparatus of claim 1, wherein the ejector plate protrudes out of the front end portions of the guide side plates.

6. The paper discharge apparatus of claim 5, wherein the ejector plate is positioned in the opening of the stapler.

7. A paper discharge apparatus comprising:

a pair of guide side plates including first rail grooves configured to circulate in a transfer direction of paper transferred to a paper stacking plate and curved cams adjacent to the first rail grooves;

a pair of paper gripping units to grip the paper received on the paper stacking plate when making contact with the curved cams while moving along the first rail grooves of the guide side plates;

a first driving unit to drive the paper gripping units to allow the paper gripping units to circulate along the first rail grooves;

an aligning stopper for discharged paper, which is provided between the guide side plates to straightly move by a predetermined distance in the paper transfer direction from front end portions of the guide side plates; and a second driving unit to previously move the aligning stopper in the paper transfer direction just before the paper gripping units reach the front end portions of the guide side plate, wherein the aligning stopper includes second rail grooves provided in inner surfaces of the guide side plates in parallel to the first rail grooves, respectively, a slide block having both ends fitted into the second rail grooves to move back and forth along the second rail grooves, and an ejector plate coupled with a top surface of the slide block to stop and transfer an end portion of the paper which is transferred to the paper stacking plate, in which the slide block moves back and forth along the second rail grooves by the second driving unit.

8. The paper discharge apparatus of claim 7, wherein the ejector plate protrudes out of the front end portions of the guide side plates.

9. The paper discharge apparatus of claim 8, further comprising a stapler having an opening, wherein the stapler is installed outside the front end portions of the guide side plates, and the ejector plate is positioned in the opening of the stapler.

* * * * *